US007887005B2

(12) United States Patent
Troutman et al.

(10) Patent No.: US 7,887,005 B2
(45) Date of Patent: Feb. 15, 2011

(54) EASY-LOAD HOUSEHOLD AUTOMATIC PAPER TOWEL DISPENSER

(75) Inventors: William Bryant Troutman, Charlotte, NC (US); William Bryant Troutman, II, Charlotte, NC (US)

(73) Assignee: Innovia Intellectual Properties, LLC, Charlotte, NC (US)

( * ) Notice: Subject to any disclaimer, the term of this patent is extended or adjusted under 35 U.S.C. 154(b) by 433 days.

(21) Appl. No.: 11/854,193

(22) Filed: Sep. 12, 2007

(65) Prior Publication Data

US 2009/0065628 A1 Mar. 12, 2009

(51) Int. Cl.
*B65H 26/06* (2006.01)

(52) U.S. Cl. ..... 242/563.2; 242/419.5; 242/564.4

(58) Field of Classification Search ..... 242/563, 242/563.2, 564, 564.1, 564.3, 564.4, 565, 242/566, 418, 419, 419.5; 312/34.8; 225/93, 225/106; 226/181

See application file for complete search history.

(56) References Cited

U.S. PATENT DOCUMENTS

| | | | | |
|---|---|---|---|---|
| 2,193,759 | A * | 3/1940 | Birr | 226/131 |
| RE22,565 | E | 11/1944 | Gillanders et al. | |
| 3,575,328 | A | 4/1971 | Jespersen et al. | |
| 3,730,409 | A | 5/1973 | Ratti | |
| RE28,911 | E | 7/1976 | Jespersen et al. | |
| 4,137,805 | A | 2/1979 | DeLuca et al. | |
| 4,142,431 | A | 3/1979 | Jespersen | |
| 4,188,844 | A | 2/1980 | DeLuca | |
| 4,203,562 | A | 5/1980 | DeLuca et al. | |
| 4,206,858 | A | 6/1980 | DeLuca et al. | |
| 4,236,679 | A | 12/1980 | Jespersen | |
| 4,286,489 | A | 9/1981 | DeLuca | |
| 4,307,638 | A | 12/1981 | DeLuca et al. | |
| 4,307,639 | A | 12/1981 | DeLuca | |
| 4,340,195 | A | 7/1982 | DeLuca | |
| 4,404,880 | A | 9/1983 | DeLuca | |
| 4,666,099 | A * | 5/1987 | Hoffman et al. | 242/564.1 |
| 4,738,176 | A | 4/1988 | Cassia | |
| 4,817,483 | A | 4/1989 | Armbruster | |
| 4,856,724 | A | 8/1989 | Jespersen | |
| 4,944,466 | A | 7/1990 | Jespersen | |
| D312,369 | S | 11/1990 | DeLuca et al. | |
| D316,788 | S | 5/1991 | Fischer et al. | |
| 5,020,403 | A | 6/1991 | D'Angelo et al. | |
| 5,048,386 | A | 9/1991 | DeLuca et al. | |
| 5,078,033 | A | 1/1992 | Formon | |
| 5,137,173 | A | 8/1992 | Hughes et al. | |
| 5,249,755 | A | 10/1993 | Jespersen | |
| 5,271,574 | A | 12/1993 | Formon et al. | |
| 5,288,032 | A | 2/1994 | Boone et al. | |
| 5,294,192 | A | 3/1994 | Omdoll et al. | |

(Continued)

*Primary Examiner*—William A Rivera
(74) *Attorney, Agent, or Firm*—Tillman Wright, PLLC; Chad D. Tillman; Jeremy C. Doerre

(57) ABSTRACT

There is provided a towel dispenser that includes a housing for containing toweling. The toweling includes a first towel and a second towel that are connected together and separable at a perforation formed between the first and second towel. The housing is configured to define a path P for the toweling. A motor and a perforation sensor are provided for dispensing the toweling and are electrically connected together. The perforation sensor is configured to generate a signal indicative of the presence of the perforation and the motor is configured to deactivate in response to the signal.

9 Claims, 6 Drawing Sheets

U.S. PATENT DOCUMENTS 5,314,131 A 5/1994 McCanless et al.
5,375,785 A 12/1994 Boone et al.
5,441,189 A 8/1995 Formon et al.
5,452,832 A * 9/1995 Niada ..... 242/564.4
5,526,973 A 6/1996 Boone et al.
5,558,302 A 9/1996 Jespersen
5,601,253 A 2/1997 Formon et al.
5,772,291 A 6/1998 Byrd et al.
5,979,821 A * 11/1999 LaCount et al. ..... 242/564.4
D419,014 S 1/2000 Fluegge et al.
D419,805 S 2/2000 Fluegge et al.
6,032,898 A * 3/2000 LaCount et al. ..... 242/564.4
6,105,898 A 8/2000 Byrd et al.
6,152,397 A 11/2000 Purcell
6,354,533 B1 3/2002 Jespersen
6,412,679 B2 7/2002 Formon et al.
6,554,158 B2 4/2003 Kapiloff et al.
6,695,246 B1 2/2004 Elliot et al.
6,710,606 B2 3/2004 Morris
6,742,689 B2 6/2004 Formon et al.
6,745,927 B2 6/2004 Formon et al.
6,758,434 B2 7/2004 Kapiloff et al.
6,766,977 B2 * 7/2004 Denen et al. ..... 242/563
6,826,985 B2 12/2004 Broehl
6,826,991 B1 12/2004 Rasmussen
6,830,210 B2 12/2004 Formon et al.
6,854,684 B2 * 2/2005 Byrd et al. ..... 242/563
6,959,891 B2 11/2005 Kapiloff et al.
6,964,395 B1 11/2005 Lewis et al.
6,994,408 B1 * 2/2006 Bunnell ..... 312/34.8
7,040,567 B1 5/2006 Lewis et al.
D522,781 S 6/2006 Wieser et al.
7,114,677 B2 10/2006 Formon et al.
7,168,602 B2 1/2007 Broehl
7,185,841 B2 3/2007 Kaufmann
7,185,842 B2 3/2007 Lewis et al.
7,191,977 B2 * 3/2007 Denen et al. ..... 242/563.2
7,219,852 B2 5/2007 Tramontina et al.
7,237,744 B2 7/2007 Morris et al.
D550,999 S 9/2007 Formon et al.
D564,269 S 3/2008 Paal et al.
7,341,170 B2 3/2008 Boone
7,347,134 B2 3/2008 Lewis et al.
7,406,901 B2 8/2008 Schmidt et al.
7,568,652 B2 8/2009 Cittadino et al.
7,624,664 B2 12/2009 Morris et al.
2004/0251375 A1 * 12/2004 Denen et al. ..... 242/563
2006/0138274 A1 * 6/2006 Goeking et al. ..... 242/564.4

* cited by examiner

EASY-LOAD HOUSEHOLD AUTOMATIC PAPER TOWEL DISPENSER

BACKGROUND OF THE INVENTION

This invention relates generally to towel dispensers and more particularly to "hands free" towel dispensers.

Towel dispensers are well known and generally include a housing configured to receive a roll of toweling, a guide system that defines a path for the toweling, and a motor for moving the toweling along the path to the exterior of the housing. The guide system can include rollers or fixed guides and typically includes a driven roller connected to the motor. A switch or sensor for detecting motion or proximity of an object is provided to initiate the operation of the motor. For example, in a known dispenser, a controller is electrically connected to the sensor and is configured to activate the motor when the sensor generates a signal that indicates the presence of a hand. Conventional towel dispensers are configured to dispense towels from continuous rolls of non-perforated toweling and include a device for cutting the toweling to dispense individual towels. The length of the individual towels provided by the dispenser is determined by the amount of time that the motor is operated or by measuring the individual towel as it is dispensed.

Conventional toweling dispensers operate as follows. A roll of toweling is placed within the housing and threaded through the guide system. A user causes a towel to be dispensed by placing a hand or other object near the sensor. Alternatively, the dispensing of toweling can be initiated by pressing a button or switch that is configured to activate the motor. Dispensing of the toweling can be stopped when the hand is removed or when a predetermined length of toweling has been dispensed.

One problem associated with conventional toweling dispensers is that they are not configured to accommodate typical pre-perforated toweling such as that used typical households. Another problem with conventional dispensers is that they can be difficult to load and thread the toweling along the path defined by the guide system.

BRIEF SUMMARY OF THE INVENTION

Accordingly, there is a need to provide a towel dispenser for automatically dispensing an individual towel wherein the length is determined by a pre-made perforation such as those formed in consumer paper towels.

There is a further need to provide a towel dispenser in which toweling can be relatively easily loaded.

Therefore there is provided a towel dispenser that includes a housing for containing toweling. The toweling includes a first towel and a second towel that are connected together and separable at a perforation formed between the first and second towel. The housing is configured to define a path P for the toweling. A motor and a perforation sensor are provided for dispensing the toweling and are electrically connected together. The perforation sensor is configured to generate a signal indicative of the presence of the perforation and the motor is configured to deactivate in response to the signal.

According to another embodiment of the present invention, the motor and a controller are positioned within the housing. The controller is electrically connected to both the motor and the perforation sensor and is configured to activate and deactivate the motor after the perforation sensor generates the signal indicative of a perforation.

According to another embodiment of the present invention, the controller is configured to deactivate the motor a predetermined period of time after receiving the signal.

According to another embodiment of the present invention, the predetermined period of time is sufficient for the perforation to exit the housing.

According to another embodiment of the present invention, the predetermined period of time is sufficient for the perforation to be aligned with a separation device.

According to another embodiment of the present invention, the housing includes a separation device when the motor is deactivated.

According to another embodiment of the present invention, the separation device is an edge positioned near the path P.

According to another embodiment of the present invention, there is provided a drive roller and a sensor roller, each having outer surfaces that define a portion of path P.

According to another embodiment of the present invention, the perforation is expanded opened when the perforation is in proximity to the sensor.

According to another embodiment of the present invention, the drive roller is configured to operate such that it has a first surface speed and the sensor roller is configured to operate such that it has a second surface speed.

According to another embodiment of the present invention, the first surface speed of the drive roller is greater than the second surface speed of the sensor roller such that the toweling is in tension between the drive roller and the sensor roller.

According to another embodiment of the present invention, the sensor roller is generally cylindrical and defines a first diameter at each of a first end and a second end and a second diameter between the first end and the second end, wherein the second diameter is greater than the first diameter.

According to another embodiment of the present invention, the second diameter is defined by a ridge formed between the first and second end of the sensor roller.

According to another embodiment of the present invention, the housing includes a guide system that defines path P and includes a first set of guiding members positioned on a first side of the toweling and a second set of guiding members positioned on a second side of the toweling.

According to another embodiment of the present invention, the housing includes a main body and a loading door pivotally attached to the main body and movable between a closed first position and an open second position, the second set of guiding members being attached to the loading door.

According to another aspect of the present invention, there is provided a method of dispensing towels from a dispenser. A housing is provided for containing toweling. The toweling includes a first towel and a second towel that are connected together and separable at a perforation formed between the first and second towel, the housing being configured to define a path P for the toweling. A motor and a sensor for sensing the perforation are electrically connected together. The sensor is configured to generate a signal indicative of the presence of the perforation and the motor is configured to deactivate accordingly. The motor is activated to propel the toweling along path P. The motor is deactivated after the sensor generates a signal indicating the presence of the perforation.

According to another embodiment of the present invention, a controller is provided that is electrically connected to the motor and to the sensor, and the controller is configured to deactivate the motor a predetermined period of time after the signal is generated by the sensor.

According to another embodiment of the present invention, the perforation is opened when the perforation is near the sensor.

According to another embodiment of the present invention, a drive roller and a sensor roller are configured to be driven by the motor, wherein the toweling contacts drive roller in path P after it contacts the sensor roller in path P. The drive roller and the sensor roller are operated such that the drive roller has a faster surface speed than the sensor roller such that tension is applied to the toweling between the drive roller and the sensor roller.

According to another embodiment of the present invention, the motor is operated until the perforation has traveled along path P past the drive roller.

According to another embodiment of the present invention, there is provided a method for loading a towel dispenser. A housing for receiving toweling is provided, wherein the toweling includes a first towel and a second towel that are connected together and separable along a perforation formed between the first and second towel. A movable loading door is attached to the housing and has an open first position wherein toweling can be loaded into the housing and a closed second position. The housing also includes a guide system configured to define a path P for the toweling and the guide system includes a first set of guiding members attached to the housing and a second set of guiding members attached to the loading door such that the guide system defines path P when the loading door is in the first position. The loading door is moved to the open second position. Toweling is placed within the housing. A length of toweling is extended from the housing over the loading door. The loading door is moved to the closed first position such that toweling extends along path P.

According to another embodiment of the present invention, a motor and a controller are positioned within the housing for dispensing the toweling are provided. A sensor for sensing the perforation is also provided wherein the sensor is configured to generate a signal indicative of the presence of the perforation and the controller is configured to receive the signal and to deactivate the motor.

BRIEF DESCRIPTION OF THE DRAWINGS

The subject matter that is regarded as the invention may be best understood by reference to the following description taken in conjunction with the accompanying drawing figures in which.

DETAILED DESCRIPTION OF THE INVENTION

Figure 1:
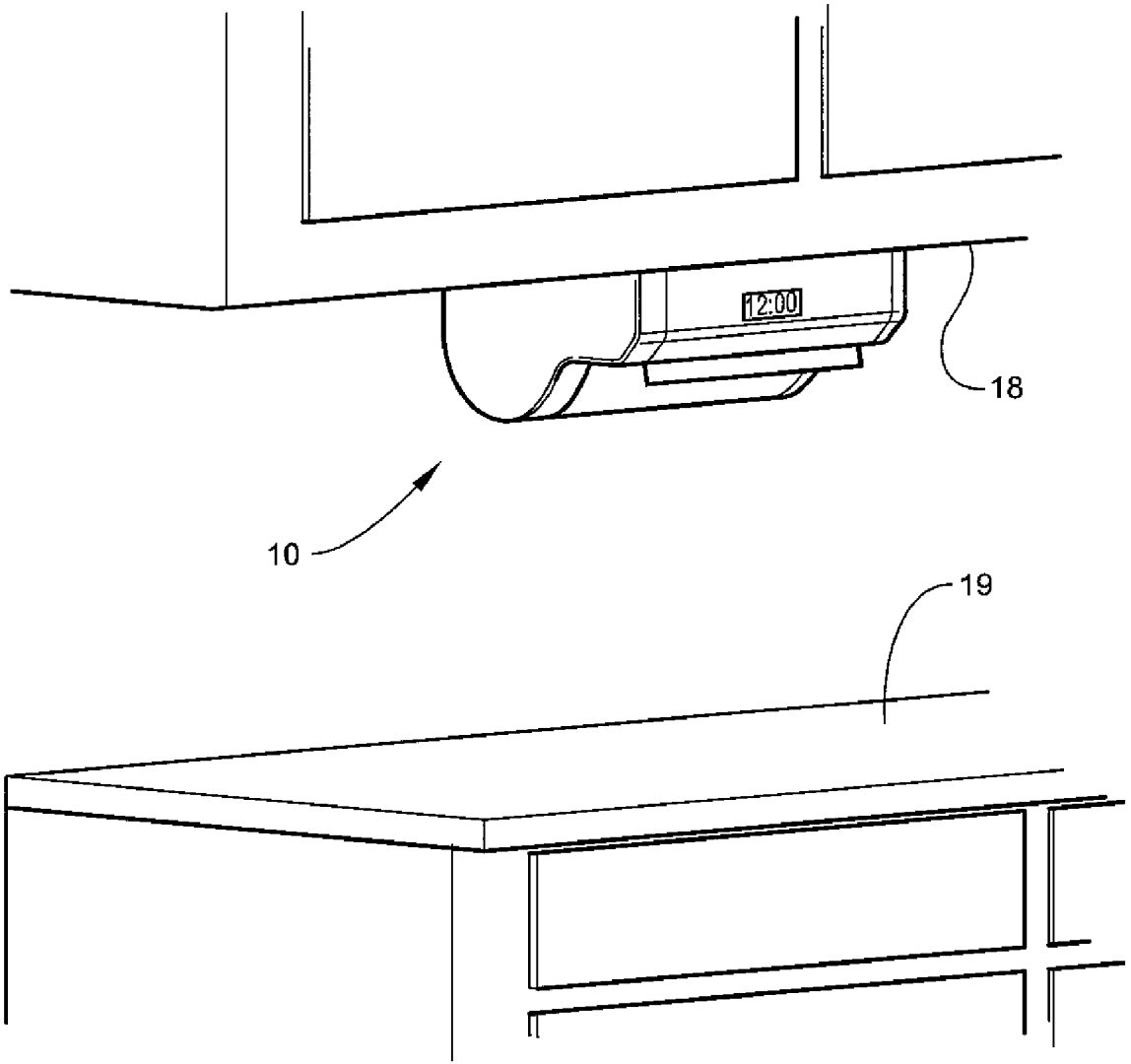
FIG. 1 is a perspective view of a towel dispenser according to one embodiment of the present invention showing the dispenser in a typical application.

Referring to the drawings wherein identical reference numerals denote the same elements throughout the various views, FIG. 1 shows a towel dispenser 10 according to one embodiment of the present invention. The dispenser 10 is for automatically dispensing conventional pre-perforated paper towels such that they can be separated at a perforation 16. Therefore the dispenser 10 can be mounted where consumer paper towels are typically made available such as under a household cabinet 18 and above a counter 19 as shown in FIG. 1.

Figure 2:
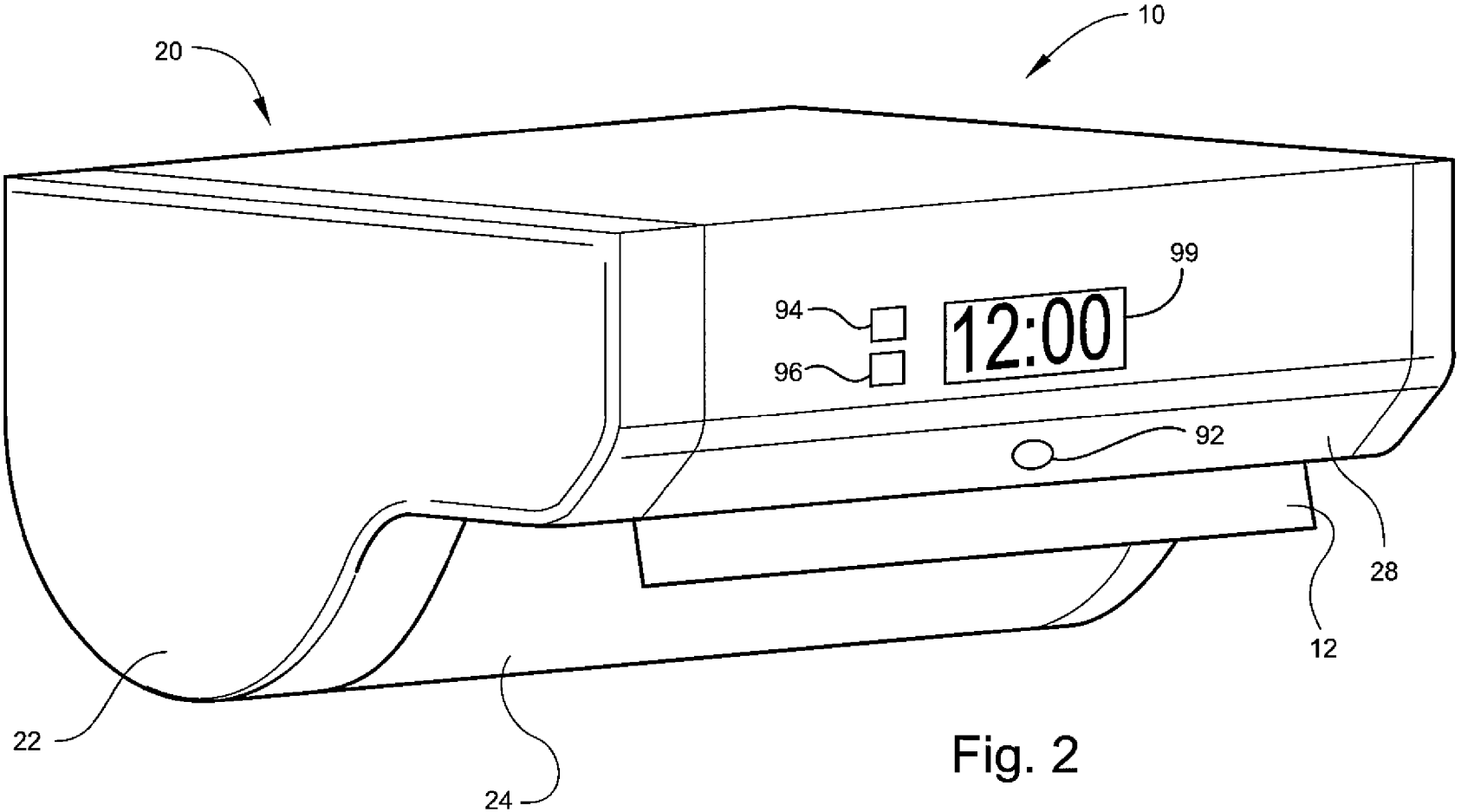
FIG. 2 is a perspective view of the towel dispenser shown in FIG. 1.
Figure 3:
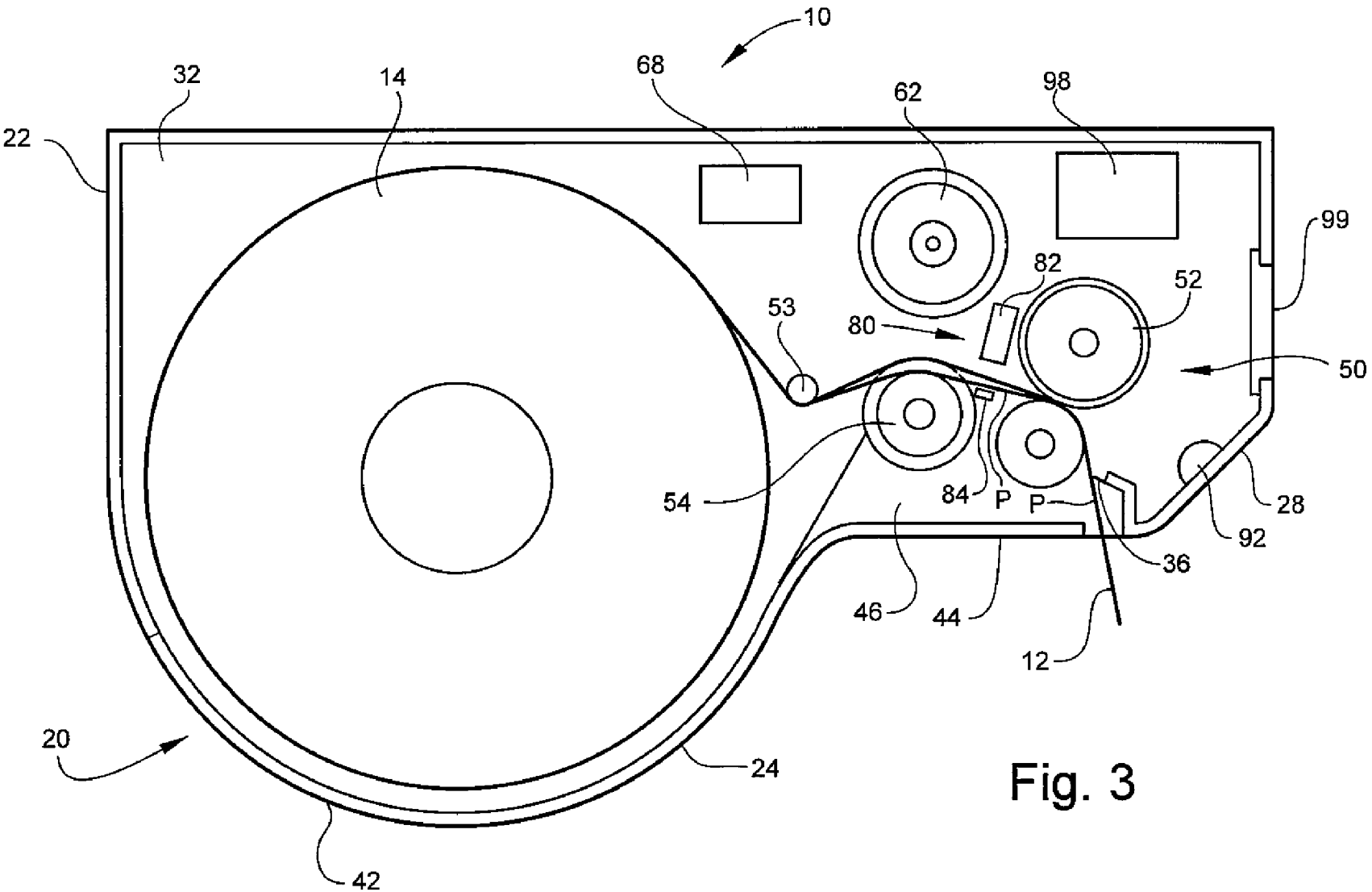
FIG. 3 is a side cut-away schematic view of a portion of the dispenser shown in FIG. 1 showing a first toweling path.
Figure 6:
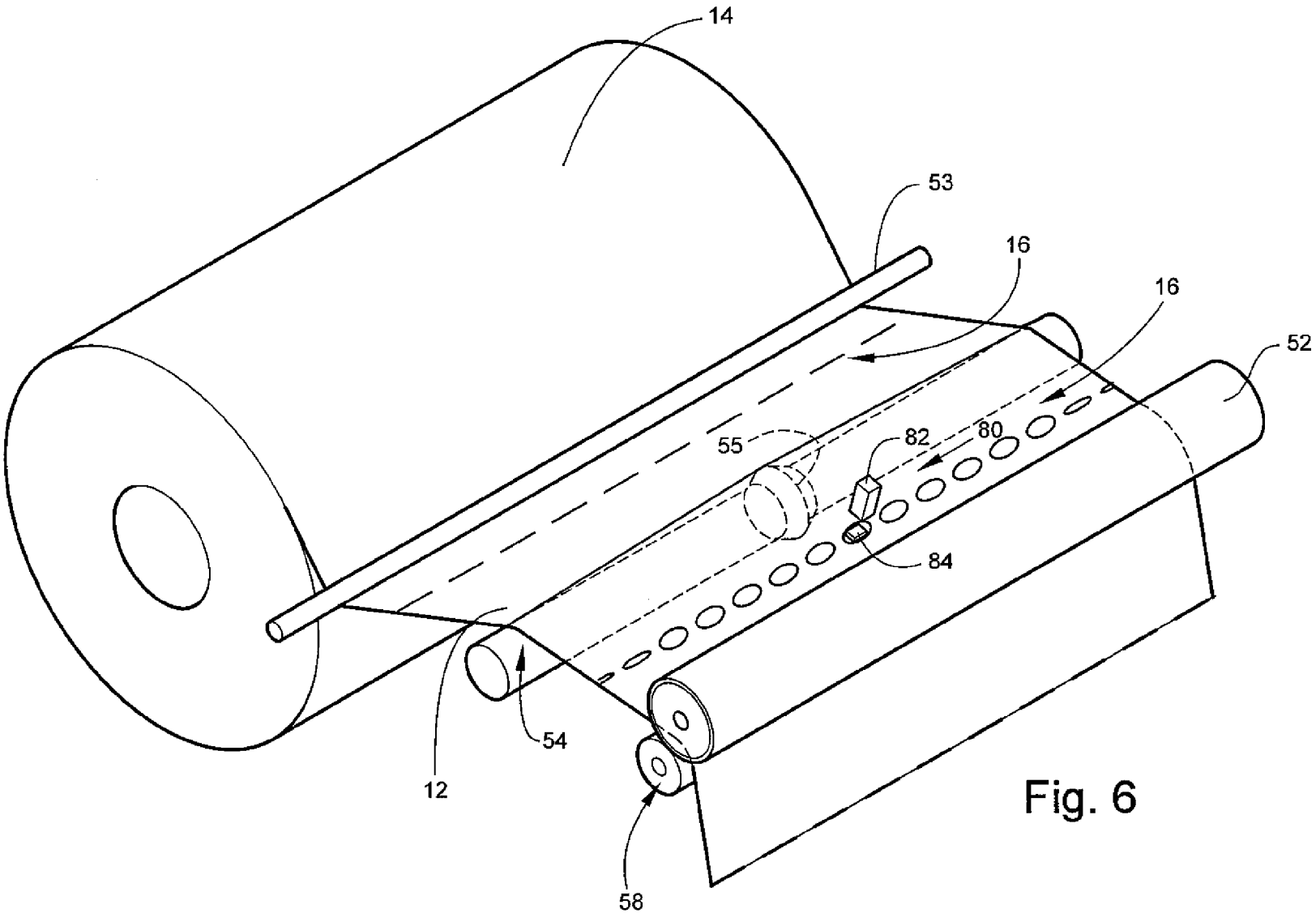
FIG. 6 is a partial perspective schematic view of a portion of the dispenser during operation of one embodiment of the present invention.

Referring now to FIGS. 2 and 3, dispenser 10 includes a housing 20 that includes a main body 22 and a loading door 24. The main body 22 includes side walls 26 and a front wall 28. The main body 22 defines a cavity 32 that is dimensioned to receive toweling 12. In this regard, tabs 34 are positioned within cavity 32 on opposite sides of cavity 32 for supporting the toweling 12. In the illustrated embodiment, the cavity 32 is dimensioned to receive the toweling 12 in the form of a roll 14 of standard consumer paper toweling but it should be appreciated that the toweling 12 could be accordion folded or the like. A perforation 16 (as shown in FIG. 6) is formed within the toweling 12 of roll 14. The perforation 16 is dimensioned to define an edge of an individual towel and to assist separation of individual towels from the roll 14. Roll 14 will typically contain many perforations 16. It should be appreciated that, alternatively, the toweling 12 could be accordion folded or otherwise provided. One edge of front wall 28 defines a separation device 36 for further assisting the separation of individual towels from roll 14.

As used herein, the term "toweling" refers to any sheet or web material that is suitable for wiping or drying. By way of example and not limitation, toweling 12 can be formed of paper, a synthetic material (such as a polymeric film), woven textile, or a non-woven textile material. As used herein, the term "perforation" refers to the point of separation between individual sheets within the toweling 12 and can be defined by a score, a opening or row of openings formed in toweling 12 such that an individual towel can be separated from the toweling 12.

The loading door 24 is pivotally attached to the main body 22 and movable between a closed first position and an open second position. When in the closed first position, the door 24 covers an opening 38 that is formed in the main body 22. When in the open second position, the door 24 provides for access to the cavity 32 through the opening 38. Position indicating sensors (not shown) are provided for generating a signal indicative of the position of the door 24. The door 24 includes a curved body 42, a lip 44, and two bracket walls 46 that are disposed generally perpendicularly to the lip 44 and at opposite sides thereof. As can be seen in FIG. 1, when the door 24 is in the closed first position, lip 44 of door 24 and the front wall 28 define a gap 45.

Figure 4:
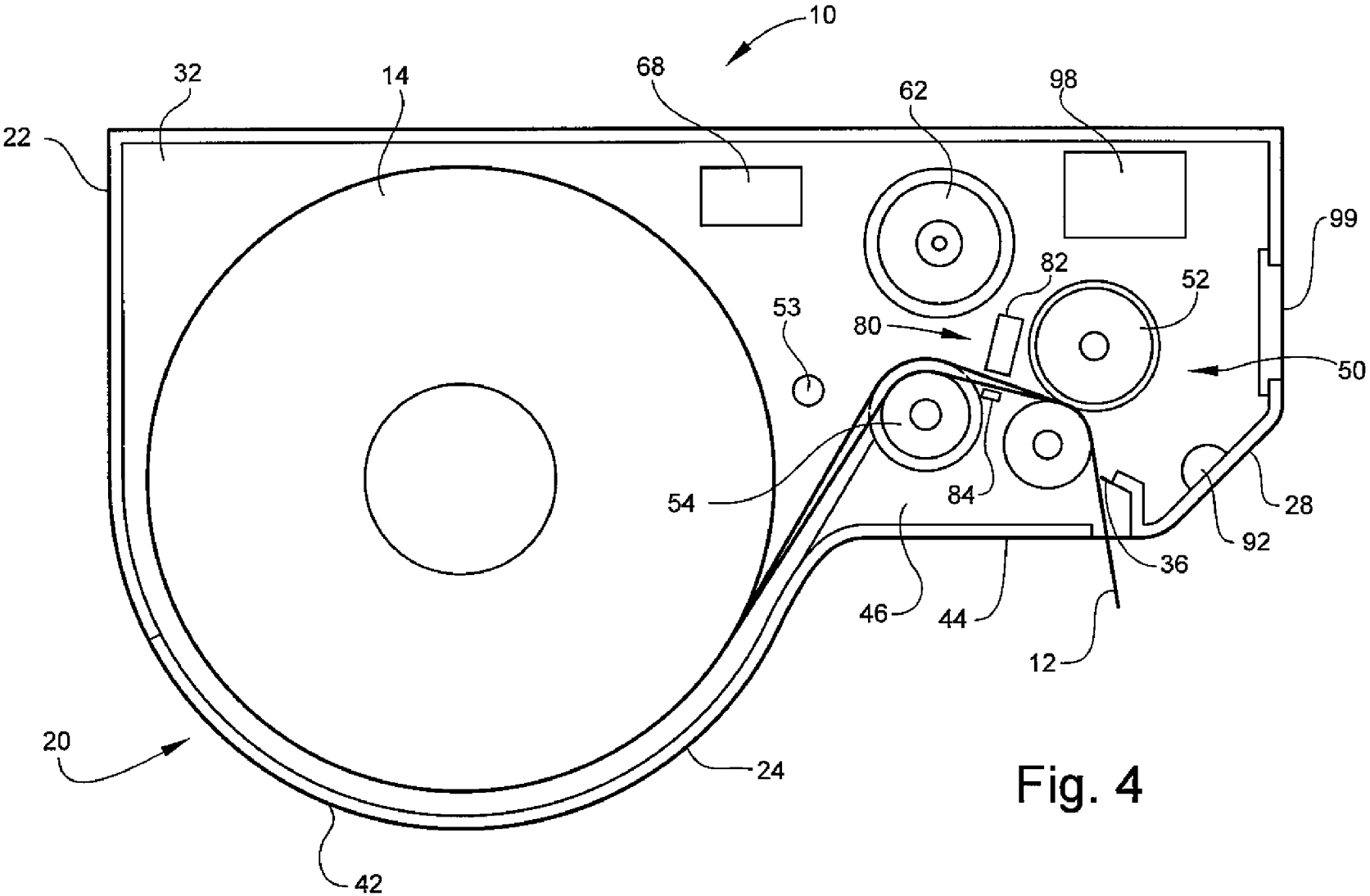
FIG. 4 is a side cut-away schematic view of a portion of the towel dispenser shown in FIG. 1 showing a second toweling path.
Figure 5:
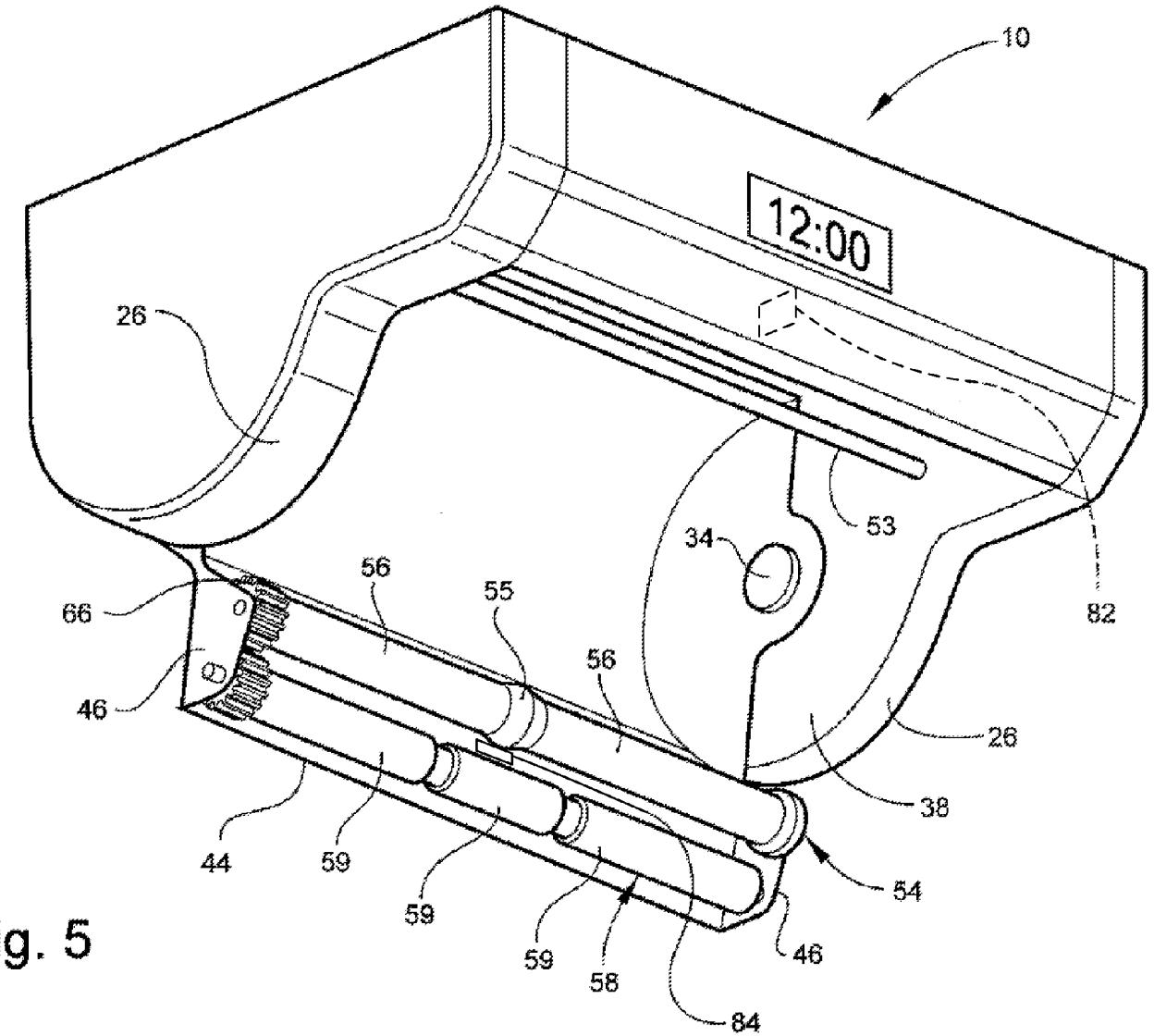
FIG. 5 is a perspective schematic view of a portion of the dispenser in an open position for receiving a roll of toweling.

Referring now to FIG. 5, a guide system 50 is positioned within the housing 20 and includes a plurality of guiding members. The guide system 50 defines a path P as shown in FIGS. 3 and 4. The path P can contact the guide bar 53 as shown in FIG. 3 or can bypass the guide bar 53 as shown in FIG. 4. The guide system 50 is configured such that when the roll 14 of toweling 12 is positioned within the cavity 32, toweling 12 extends along path P through the gap 45.

A first set of guiding members are attached to the main body 22 and include a drive roller 52 and a guide bar 53. The drive roller 52 extends between side walls 26 and is positioned between cavity 32 and front wall 28. Guide bar 53 also extends between side walls 26 and is positioned between the drive roller 52 and the cavity 32. A second set of guiding members includes a rotatable sensor roller 54 and rotatable a pinch roller 58 that each extend between the two bracket walls 46 and are movable with the door 24.

Continuing to refer to FIG. 5, the sensor roller 54 is generally cylindrical and is connectable to a motor 62 via a transmission and that includes a gear 66 that is attached to the sensor roller 54. In the illustrated embodiment, the sensor roller 54 is configured to be driven such that it has a slower surface speed that the drive roller 52. In this manner, tension is created in toweling 12 between the sensor roller 54 and the drive roller 52 such that the perforation 16 can be expanded. Alternatively, the sensor roller 54 is not attached to the motor 62 but is configured to be rotated by contact with the toweling 12.

In the illustrated embodiment, the sensor roller 54 has a centrally formed circumferential ridge 55 disposed between two end sections 56. The end sections 56 have a first diameter and the ridge 55 has an second diameter. The second diameter of the ridge 55 is greater than the first diameter and is for expanding the perforation 16 as it passes over the sensor roller 54. Alternatively, the sensor roller 54 could have a consistent diameter across its full length and could be straight or bowed for expansion of the perforation 16.

As can be seen in FIG. 5, the sensor roller 54 is positioned generally parallel to the pinch roller 58. The pinch roller 58 is generally cylindrical and of uniform diameter and includes a plurality of sub-rollers 59. The pinch roller 58 is also connectable to motor 62 via the transmission.

Referring now to FIGS. 3 and 4, the motor 62 is mounted on one of the side walls 26 and is configured to be powered by a battery 68. The motor 62 is mechanically connected to the drive roller 52 by the transmission. In the illustrated embodiment, the transmission includes a plurality of gears. As used herein, the term "gears" refers to a device having a toothed surface that is configured to interlock with another toothed surface. Alternatively the transmission could include a belt and pulley, wheels, or other such power transmitting structure.

Referring now to FIG. 3, a perforation sensor 80 is included in the housing 20 and is configured to generate a signal indicative of the presence of a perforation 16 in the toweling 12, i.e., a perforation signal. In the illustrated embodiment, the perforation sensor 80 is a photo-electronic device and includes a light source 82 positioned on one side of path P and a photo-conductive receiver 84 positioned on an opposite side of path P and is operable to detect light from the light source 82. The sensor 80 is configured to generate a signal when it receives light from the light source 82. In this regard, light from the light source 82 is normally blocked by the toweling 12 between the light source 82 and the receiver 84. However, if a perforation 16 is positioned between the light source 82 and the receiver 84, then the light passes through the perforation 16 to the receiver 84 and the sensor 80 generates the perforation signal. In the illustrated embodiment, the light from the light source 82 is directed at a relatively small portion relative to the width of the toweling 12. In other embodiments the light source 82 and the receiver 84 can be configured such that the light source 82 emits light that is directed to more of the toweling 12, up to the full width of the toweling 12.

Alternatively, the light source 82 and the receiver 84 could be positioned on the same side of the path P and a reflector (not shown) positioned on the opposite side of the path P. It should also be appreciated that the sensor 80 can be based on other known technologies such as the following: The sensor 80 can be capacitive and use a capacitive coupled sensor. The sensor 80 can be based on mechanical detection and detect a perforation 16 through movement of a micro-switch that mechanically changes states when a perforation 16 moves past the sensor 80. The sensor 80 can be based on the hall effect and be configured to sense a marker on the toweling 12 such as a metal flag. The sensor 80 could be configured to detect a perforation 16 based on a change in radio frequency.

A proximity sensor 92 is mounted on main body 22 as shown in FIGS. 2 and 3. The proximity sensor 92 is configured to generate a signal that is indicative of the presence of a hand or other object. An alternative on switch 94 is positioned on the housing 20 and is operable to close an electrical circuit. An emergency off switch 96 is positioned on the housing 20 and is operable to close an electrical circuit.

A controller 98 is mounted within the housing 20, as shown in FIG. 3, and is electrically connected to the perforation sensor 80, the motor 62, the battery 68, the emergency off switch 96, the proximity sensor 92, the position indicating sensors of the loading door 24, and the on switch 94. The controller 98 is configured to activate the motor 62, based on a signal from the proximity sensor 92 or the off switch 96 and to deactivate the motor 62 after the perforation signal is generated by perforation sensor 80. In the illustrated embodiment, the controller 98 is configured to deactivate the motor 62 a predetermined time after the perforation signal is generated such that the perforation 16 is positioned near the separation device 36. The controller 98 is also configured to activate the motor 62 when the on switch 94 is closed and to deactivate the motor 62 when the emergency off switch 96 is closed.

The present invention can be better understood with respect to the operation of the dispenser 10 as follows. Prior to dispensing towels, the roll 14 is placed within the housing 20 and a length of the toweling 12 extending from roll 14 is threaded along path P so that the toweling 12 extends from roll 14 through gap 45. Dispensing of a towel is initiated by moving an object such as a person's hand such that it is detected by the proximity sensor 92. The controller 98 activates the motor 62 in response to a signal generated by the proximity sensor 92 and toweling 12 is dispensed through gap 45. When a perforation 16 is detected by the perforation sensor 80, it generates the perforation signal that is then received by the controller 98. The controller 98 deactivates the motor 62 after the perforation 16 has passed through the gap 45. In this regard, the perforation 16 is positioned outside of the housing 20 and a towel can easily be removed by tearing the toweling 12 at the perforation 16 either free from separation device 36 or by engaging separation device 36 with the toweling at the perforation 16.

Referring now to the detection of perforation 16 by the perforation sensor 80, as can be seen in FIG. 6, each opening of the perforation 16 has a first diameter D prior to reaching the sensor roller 54. In the illustrated embodiment, each opening of the perforation 16 is expanded to have a second diameter D2 between the sensor roller 54 and the drive roller 52. Each opening of the perforation 16 is further expanded to have a third diameter D3 if the opening passes over or near ridge 55 of the sensor roller 54. The third diameter D3 is greater than the second diameter D2 which is greater than the first diameter D1. Alternatively, the sensor roller 54 and the drive roller 52 are not configured to expand the openings of the perforation 16 prior to detection of the perforation 16 by the perforation sensor 80. In this alternative, perforation sensor 80 is configured to detect the perforation 16 when the opening 38 has the first diameter D1.

The present invention also provides a method for loading the towel dispenser 10. The loading door 24 is moved to its open second position such that opening 38 is accessible and the sensor roller 54 and the pinch roller 58 are moved clear of path P. The roll 14 is inserted into the housing 20 through the opening 38 and positioned on tabs 34. A length of toweling 12 is extended from the roll 14 across the loading door 24 such that it extends over the sensor roller 54 and the pinch roller 58. The loading door 24 is moved to the closed first position such that the sensor roller 54 and the pinch roller 58 are moved up into position to define path P. In this manner, the toweling 12 that was extended over the sensor roller 54 and the pinch roller 58 is threaded along path P. The pinch roller 58 traps the toweling 12 against the drive roller 52. In one embodiment, upon closing of the loading door 24, the controller 98 activates the motor 62 to dispense an individual towel as described above.

In an alternative embodiment of the present invention, there is provided a user interface (not shown) which is configured to provide for selection of a quantity of perforations to be detected before the motor 62 is deactivated. In this manner, the user can select the number of paper towels to be dispensed during one dispensing cycle. The number selected can be displayed on display 99 as can the number of towels actually dispensed per cycle.

The foregoing has described a towel dispenser 10 capable of dispensing toweling 12 until a perforation 16 within the toweling 12 is detected. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. An automatic towel dispenser, comprising:

(a) a housing for receiving toweling, the housing including, (i) a main body, (ii) a loading door pivotally attached to the main body such that the loading door is rotatable relative to the main body, the loading door being movable between an open position and a closed position, and being configured to allow toweling to be inserted into the housing when the loading door is in the open position, and (iii) a guide system configured to define a path P for the toweling, the guide system including a first set of one or more guiding members attached to the main body and a second set of one or more guiding members attached to the loading door such that, (A) the second set of guiding members guides the toweling along a portion of the path P when the loading door is in the closed position, (B) the second set of guiding members does not guide the toweling along a portion of the path P when the loading door is in the open position, and (C) each of the one or more guiding members of the second set includes an axis of rotation that is fixed relative to the loading door regardless of whether the loading door is in the closed position or the open position;

(b) a motor for driving dispensing of toweling from the housing; and (c) a sensor electrically connected to the motor;

(d) wherein the sensor is configured to generate a signal and the motor is configured to deactivate dispensing of toweling from the housing as a function of the signal; and (e) wherein the dispenser is configured such that a perforation of toweling received within the housing is expanded when the perforation is in proximity to the sensor.

2. An automatic towel dispenser, comprising:

(a) a housing for receiving toweling, the housing including, (i) a main body, (ii) a loading door pivotally attached to the main body such that the loading door is rotatable relative to the main body, the loading door being movable between an open position and a closed position, and being configured to allow toweling to be inserted into the housing when the loading door is in the open position, and (iii) a guide system configured to define a path P for the toweling, the guide system including a first set of one or more guiding members attached to the main body and a second set of one or more guiding members attached to the loading door such that, (A) the second set of guiding members guides the toweling along a portion of the path P when the loading door is in the closed position, (B) the second set of guiding members does not guide the toweling along a portion of the path P when the loading door is in the open position, and (C) each of the one or more guiding members of the second set includes an axis of rotation that is fixed relative to the loading door regardless of whether the loading door is in the closed position or the open position;

(b) a motor for driving dispensing of toweling from the housing; and (c) a sensor electrically connected to the motor;

(d) wherein the sensor is configured to generate a signal and the motor is configured to deactivate dispensing of toweling from the housing as a function of the signal;

(e) wherein the first set of guiding members comprises a drive roller having an outer surface that defines a portion of path P, and wherein the second set of guiding members comprises a sensor roller having an outer surface that defines a portion of path P; and (f) wherein the drive roller is configured to operate such that it has a first surface speed and the sensor roller is configured to operate such that it has a second surface speed that is different from the first surface speed.

3. An automatic towel dispenser according to claim 2, wherein the first surface speed of the drive roller is greater than the second surface speed of the sensor roller such that the toweling is in tension between the drive roller and the sensor roller.

4. An automatic towel dispenser according to claim 3, wherein the sensor roller is generally cylindrical and defines a first diameter at each of a first end and a second end and a second diameter between the first end and the second end, wherein the second diameter is greater than the first diameter.

5. An automatic towel dispenser according to claim 4, wherein the second diameter is defined by a ridge formed between the first and second end of the sensor roller.

6. A method of loading a towel dispenser having a housing for receiving toweling, wherein the housing includes, (1) a main body (2) a movable loading door secured to the main body such that the loading door is rotatable relative to the main body, the loading door being movable between an open position and a closed position, the loading door being configured to allow toweling to be inserted into the housing when the loading door is in the open position, and (3) a guide system configured to define a path P along which the toweling is guided when dispensed, the guide system including a first set of one or more guiding members attached solely to the main body and a second set of one or more guiding members attached solely to the loading door such that, (A) the second set of guiding members guides the toweling along a portion of path P when the loading door is in the closed position, (B) the second set of guiding members does not guide the toweling along a portion of path P when the loading door is in the open position, and (C) each of the at least one or more guiding members of the second set is capable of only rotational movement relative to the loading door about an axis of rotation that is located in a fixed position relative to the loading door, regardless of whether the loading door is in the closed position, the open position, or transitioning therebetween, the method comprising the steps of, (a) moving the loading door to the open position such that the second set of guiding members attached to the loading door does not guide toweling along a portion of path P;

(b) placing toweling within the housing;

(c) extending a length of toweling such that it extends across a top of each of the second set of guiding members attached to the loading door; and (d) moving the loading door to the closed position such that, (i) the first set of guiding members attached to the main body and the second set of guiding members attached to the loading door each guides the toweling along a portion of path P, and (ii) the toweling is threaded along path P by the act of the loading door being moved to the closed position while the length of toweling extends across the top of each of the second set of guiding members attached to the loading door.

7. The method of claim 6, further comprising the step of mounting the towel dispenser to the underside of a household cabinet such that the loading door rotates away from the underside of the cabinet and extends generally downwardly when moved from the closed position to the open position for receiving placement of the toweling within the housing.

8. The method of claim 6, wherein the first set of one or more guiding members comprises a drive roller and the second set of one or more guiding members comprises a pinch roller, and wherein the method further comprises dispensing an extent of the toweling after the loading door is moved from the open position to the closed position, the toweling being trapped by the drive roller and the pinch roller.

9. A method of loading a towel dispenser, having a housing for receiving toweling, wherein the housing includes, (1) a main body (2) a movable loading door secured to the main body such that the loading door is rotatable relative to the main body, the loading door being movable between an open position and a closed position, the loading door being configured to allow toweling to be inserted into the housing when the loading door is in the open position, and (3) a guide system configured to define a path P along which the toweling is guided when dispensed, the guide system including a first guiding member attached to the main body and a second guiding member attached to the loading door such that, (A) the second guiding member guides the toweling along a portion of path P when the loading door is in the closed position, and (B) the second guiding member does not guide the toweling along a portion of path P when the loading door is in the open position, the method comprising the steps of, (a) moving the loading door to the open position such that the second guiding member attached to the loading door does not guide toweling along a portion of path P;

(b) placing toweling within the housing;

(c) extending a length of toweling such that it extends across a top of the second guiding member attached to the loading door; and (d) moving the loading door to the closed position such that, (i) the first guiding member attached to the main body and the second guiding member attached to the loading door each guides the toweling along a portion of path P, and (ii) the toweling is threaded along path P by the act of the loading door being moved to the closed position from the open position while the length of toweling extends across the top of the second guiding member attached to the loading door.

* * * * *